US006778811B1

(12) United States Patent
Grove

(10) Patent No.: US 6,778,811 B1
(45) Date of Patent: Aug. 17, 2004

(54) ELECTRONIC DEVICE WITH CONCEALED FIREARM SYSTEM

(76) Inventor: Ken Grove, P.O. Box 8502, Clearwater, FL (US) 33758

( * ) Notice: Subject to any disclaimer, the term of this patent is extended or adjusted under 35 U.S.C. 154(b) by 601 days.

(21) Appl. No.: 09/877,454

(22) Filed: Jun. 8, 2001

Related U.S. Application Data

(63) Continuation-in-part of application No. 09/283,721, filed on Apr. 1, 1999, now abandoned.

(51) Int. Cl.[7] ..... F41H 9/00

(52) U.S. Cl. ..... 455/66.1; 455/1; 42/1.09; 42/1.16; 42/1.01; 224/539

(58) Field of Search ..... 455/1, 66.1; 42/1.01, 42/1.09, 1.16, 70.11, 84; 224/539

(56) References Cited

U.S. PATENT DOCUMENTS 5,511,711 A * 4/1996 Kunz ..... 224/539
5,782,025 A * 7/1998 Yoder ..... 42/1.09
5,988,450 A * 11/1999 Cassarino ..... 222/192
6,321,478 B1 * 11/2001 Klebes ..... 42/84

* cited by examiner

*Primary Examiner*—Nick Corsaro
*Assistant Examiner*—Alan T. Ganty
(74) *Attorney, Agent, or Firm*—Edward P. Dutkiewicz

(57) ABSTRACT

An electronic device with a concealed firearm. The device includes a housing having an interior face and an exterior face and with a cavity therein. The housing has a plurality of buttons and digital electronics. A tubular wall with a rigid central bore is adapted to function as the barrel of a firearm. The tubular wall has an interior end communicating with the cavity and an exterior end communicating with exterior of the housing. A chamber is provided for receiving a bullet adjacent to the interior end of the bore. A striker element is positioned at the end of the bullet with a point adapted to strike the shell to discharge the bullet and propel the slug thereof outwardly therefrom. An actuator is located on the side of the striker remote from the bullet to initiate movement of the striker element. A mechanism, when activated, is adapted to release the actuator to move the striker element and discharge the bullet. A second mechanism is positionable in association with the striker element and the bullet to constitute a safety. Primary electronic components are provided including electronic elements to allow the bullet to be discharged upon a first instruction from at least one of the buttons.

4 Claims, 3 Drawing Sheets

FIG 6
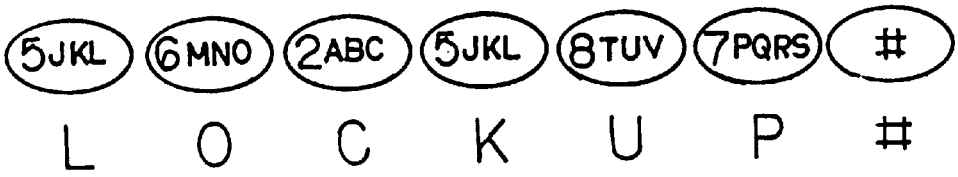
FIG 7
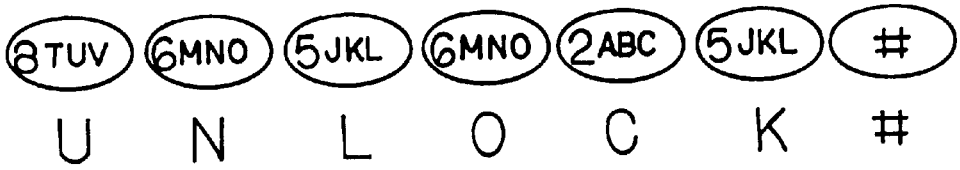
FIG 8
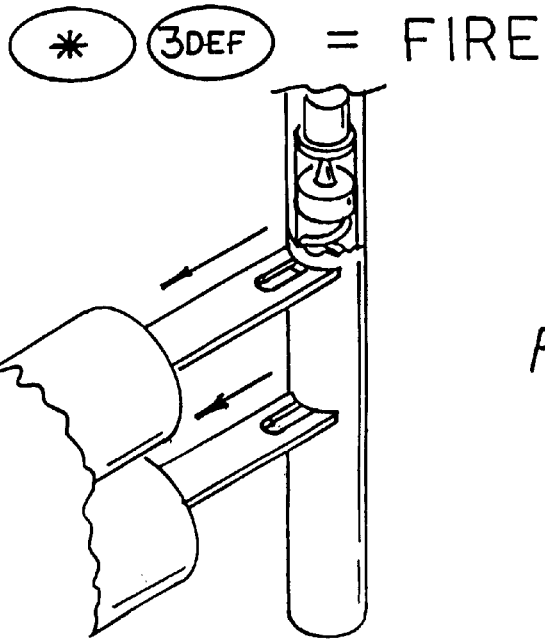
FIG 5

ELECTRONIC DEVICE WITH CONCEALED FIREARM SYSTEM

RELATED APPLICATION

The present application is a continuation in part of U.S. patent application Ser. No. 09/283,721 filed Apr. 1, 1999 now abandoned.

BACKGROUND OF THE INVENTION

1. Field of the Invention

The present invention relates to an electronic device with concealed firearm system and more particularly pertains to providing personal protection when in an adverse circumstance to a user through the use of a firearm concealed in a device which does not look like a firearm.

2. Description of the Prior Art

The use of electronic devices and firearms of known designs and configurations is known in the prior art. More specifically, electronic devices and firearms of known designs and configurations previously devised and utilized for the purpose of concealing firearms in various objects through known methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for providing personal protection when in an adverse circumstance: U.S. Pat. No. 756,182, Combined Knuckle Duster and Revolver, issued Mar. 19, 1904, to Novak; U.S. Pat. No. 1,073,312, Pistol, issued Sep. 16, 1913, to Woods; U.S. Pat. No. 3,448,541, Novelty Sounding and Projectile Firing Writing Instrument, issued Jun. 10, 1969, to Barlow; U.S. Pat. No. 3,557,481, Firearm Mounted in a Shoe Heel, issued Jan. 26, 1971, to Stuart; U.S. Pat. No. 4,154,927, Multi-function Clipboard Apparatus, issued May 8, 1979, to Owens; U.S. Pat. No. 5,001,854, Gun Safety Locking Devices, issued Mar. 26, 1991, to Derman; U.S. Pat. No. 5,303,495, Personal Weapon System, issued Apr. 19, 1994, to Harthcock; U.S. Pat. No. 5,476,192, Self-Defense Device, issued Dec. 19, 1995, to Julinot; and U.S. Pat. No. 5,720, 193, Push Button Firearm Locked issued Feb. 14, 1998, to Dick.

While these devices fulfill their respective, particular objectives and requirements, the aforementioned patents do not describe an electronic device with concealed firearm system that allows providing personal protection when in an adverse circumstance to a user through the use of a firearm concealed in a device which does not look like a firearm.

In this respect, the electronic device with concealed firearm system according to the present invention substantially departs from the conventional concepts and designs of the prior art, and in doing so provides an apparatus primarily developed for the purpose of providing personal protection when in an adverse circumstance to a user through the use of a firearm concealed in a device which does not look like a firearm.

Therefore, it can be appreciated that there exists a continuing need for a new and improved electronic device with concealed firearm system. In this regard, the present invention substantially fulfills this need.

SUMMARY OF THE INVENTION

In view of the foregoing disadvantages inherent in the known types of electronic devices and firearms of known designs and configurations now present in the prior art, the present invention provides an improved electronic device with concealed firearm system. As such, the general purpose of the present invention, which will be described subsequently in greater detail, is to provide a new and improved electronic device with concealed firearm system and method which has all the advantages of the prior art and none of the disadvantages.

To attain this, the present invention essentially comprises a new and improved electronic device with a concealed firearm system comprising, in combination, a housing having an interior face and an exterior face and a peripheral side wall there between and with a cavity there within, the side wall having a split along its length to allow for the releasable separation between the interior face of the housing and the exterior face of the housing; an ear piece and a mouth piece formed on the interior face of the housing with a keypad formed with depressable buttons, the depressable buttons including three rows and four columns, the first row having characters 1; 2,A,B,C; 3,D,E,F; the second row having characters 4,G,H.I; 5,J.K.L: 6,M.N,O; the third row having characters 7,P,R,S,; 8,T,U,V; 9,W,X,Y; and the fourth row having characters a * (star); 0,Q,Z; and # (pound); an antenna extending upwardly from one portion of the peripheral side wall, the antenna having a tubular wall with a rigid central bore and electrically conductive antenna elements within the tubular wall, and with the bore adapted to function as the barrel of a firearm; audio electronics located within the cavity coupled with respect to the ear piece, the mouth piece, conductive elements, and the keys of the pad for allowing the system to function as a cellular telephone; a chamber for receiving a single bullet formed of a shell and a slug adjacent to the interior end of the bore; a striker element positioned on the side of the bullet remote from the antenna with a point adapted to strike the shell at the rear face of the bullet to discharge the bullet and propel the slug thereof outwardly therefrom through the bore; a coil spring on the side of the striker remote from the bullet to initiate movement of the striker element into contact with the shell; a first plate when activated adapted to release the spring to move the striker element and discharge the bullet; a second plate positionable between the striker element and the bullet to constitute a safety; primary electronic components within the housing including electronic elements coupled between the keypad and the first plate to allow the bullet to be discharged upon the holding of one key, preferably the star key and upon the depression of another key, preferably the three (3) key, the electronic components also including secondary electronic elements coupled between the key pad and the safety adapted to (A) retain the safety in a first safety orientation between the striker element and bullet upon the punching in of a preselected multi-digit number and (B) retain the safety in a second release orientation not between the striker element and bullet upon punching in a separate pre-selected number, preferably a multi-digit number.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved electronic device with concealed firearm system which has all of the advantages of the prior art digital devices and firearms of known designs and configurations and none of the disadvantages.

It is another object of the present invention to provide a new and improved electronic device with concealed firearm system which may be easily and efficiently manufactured and marketed.

It is further object of the present invention to provide a new and improved electronic device with concealed firearm system which is of durable and reliable constructions.

An even further object of the present invention is to provide a new and improved electronic device with concealed firearm system which is susceptible of a low cost of manufacture with regard to both materials and labor, and which accordingly is then susceptible of low prices of sale to the consuming public and/or government agencies, thereby making such electronic device with concealed firearm system economically available to the buying public including governmental agencies.

Even still another object of the present invention is to provide an electronic device with concealed firearm system for providing personal protection when in an adverse circumstance to a user through the use of a firearm concealed in a device which does not look like a firearm.

Lastly, it is an object of the present invention to provide a new and improved electronic device with a concealed firearm. The device includes a housing having an interior face and an exterior face and a peripheral side wall there between and with a cavity therein. The housing has a plurality of buttons including a keypad and digital electronics. A tubular wall with a rigid central bore is adapted to function as the barrel of a firearm. The tubular wall has an interior end communicating with the cavity and an exterior end communicating with exterior of the housing. A chamber is provided for receiving a bullet formed of a shell and a slug adjacent to the interior end of the bore. A striker element is positioned on the end of the bullet with a point adapted to strike the shell at the rear face of the bullet to discharge the bullet and propel the slug thereof outwardly therefrom through the bore. An actuator is located on the side of the striker remote from the bullet to initiate movement of the striker element into contact with the shell. A mechanism, when activated, is adapted to release the actuator to move the striker element and discharge the bullet. A second mechanism is positionable in association with the striker element and the bullet to constitute a safety. Primary electronic components are provided within the housing including electronic elements coupled between at least one of the buttons and the first plate to allow the bullet to be discharged upon a first instruction from at least one of the buttons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of the elements of FIG. 4 but in the fired position with both plates retracted.

FIGS. 6, 7 and 8 are schematic illustrations of preferred codes to be punched in through the keypad to lock and unlock the system and to effect a firing of the bullet.

The same reference numerals refer to the same parts throughout the various Figures.

DESCRIPTION OF THE PREFERRED EMBODIMENT

Figure 1:
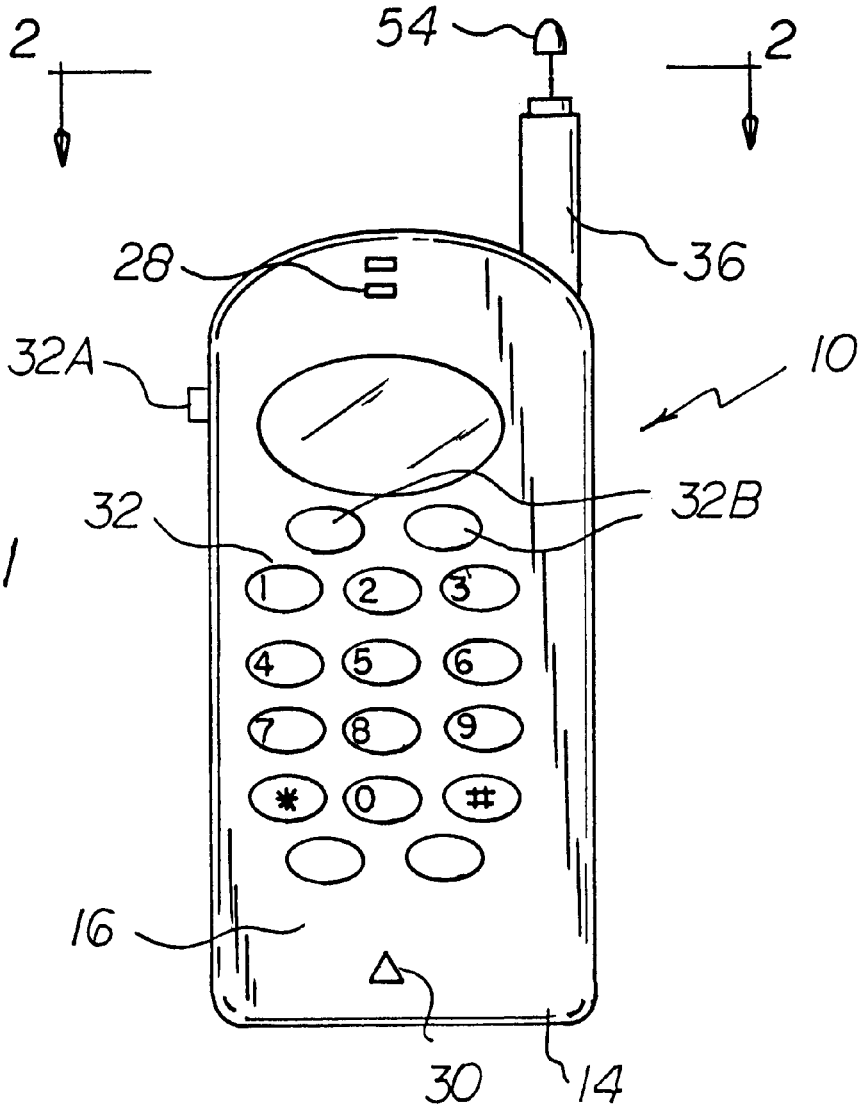
FIG. 1 is a front elevational illustration of the preferred embodiment of the telephone with a concealed firearm system constructed in accordance with the principles of the present invention.
Figure 2:
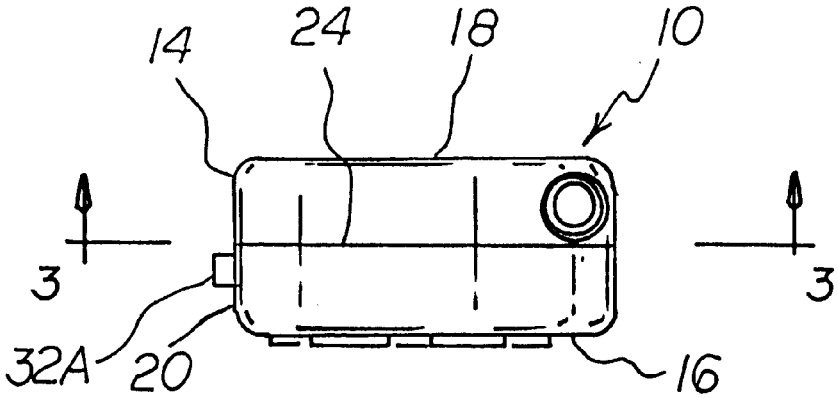
FIG. 2 is a top elevational view taken along line 2—2 of FIG. 1.

With reference now to the drawings, and in particular to FIG. 1 thereof, the preferred embodiment of the new and improved electronic device with concealed firearm system embodying the principles and concepts of the present invention and generally designated by the reference numeral 10 will be described.

The present invention, the electronic device with concealed firearm system 10 is comprised of a plurality of components. Such components in their broadest context include a housing, an ear piece, a mouth piece, buttons, an antenna, audio electronics, a cavity, a striker element, a coil spring, a first plate, a second plate, primary electronic components and secondary electronics. Each of the individual components are individually configured and correlated with respect to each other so as to attain the desired objective.

More specifically, the present invention includes a new and improved electronic device with a concealed firearm which in the primary embodiment is illustrated as a cellular telephone with a concealed firearm system. The system provides, as a first component, a housing 14 having an interior face 16 and an exterior face 18 and a peripheral side wall 20 there between and with a cavity there within. The side wall has a split 24 along its length to allow for the releasable separation between the interior face of the housing and the exterior face of the housing.

The next components of the system are an ear piece 28 and a mouth piece 30 formed on the interior face of the housing with a keypad 32 formed with depressable buttons. The depressable buttons on the keypad include three rows and four columns, the first row having characters 1; 2,A,B, C; 3,D,E,F; the second row having characters 4,G,H.I; 5,J.K.L: 6,M.N,O; the third row having characters 7,P,R,S,; 8,T,U,V; 9,W,X,Y; and the fourth row having characters a * (star); 0,Q,Z; and # (pound). In addition, supplemental buttons 32A and 32B are also provided for various supplemental functions.

Further provided is an antenna 36. The antenna extends upwardly from one portion of the peripheral side wall and has a tubular wall 38 with a rigid central bore 40 and electrically conductive antenna elements 42 within the tubular wall. The bore is adapted to function as the barrel of a firearm.

Audio electronics 44 are next provided. The audio electronics are located within the cavity coupled with respect to the ear piece, the mouth piece, conductive elements, and the keys of the pad for allowing the system to function as a cellular telephone.

The next major component of the system is chamber 48. The chamber functions for receiving a single bullet 50 formed of a shell 52 and a slug 54 adjacent to the interior end of the bore.

A striker element 56 is positioned on the side of the bullet remote from the antenna with a point 58 adapted to strike the shell at the rear face of the bullet to discharge the bullet and propel the slug thereof outwardly therefrom through the bore.

A coil spring 60 is next provided as an actuator mechanism for advancing the striker and thereby firing the bullet. The coil spring is located on the side of the striker remote from the bullet to initiate movement of the striker element into contact with the shell.

Figure 3:
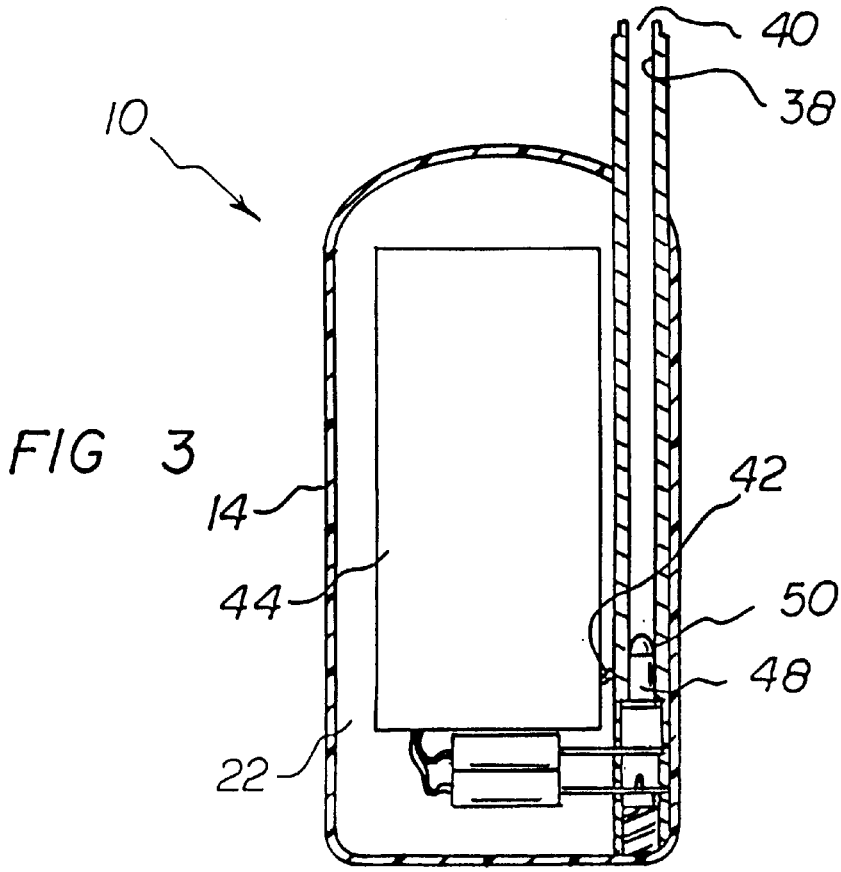
FIG. 3 is a cross-sectional view taken along line 3—3 of FIG. 2 with the two plates advanced
Figure 4:
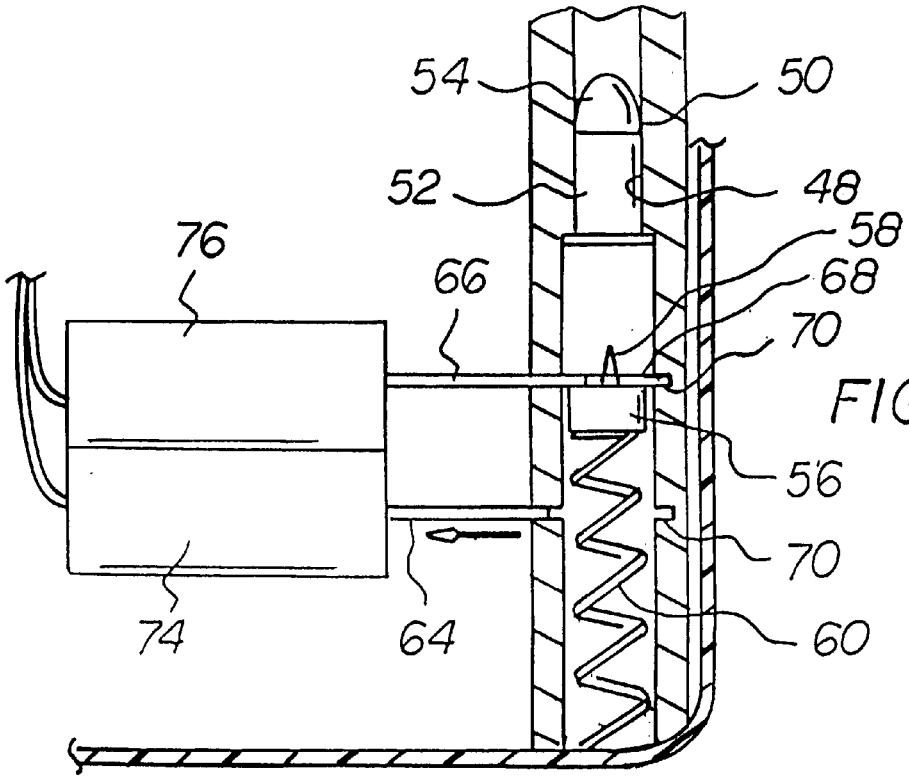
FIG. 4 is an enlarged showing from the lower right-hand area of FIG. 3 with only the safety plate advanced.

Further provided is a first plate 64. When activated, the first plate is adapted to release the spring to move the striker element and discharge the bullet when the safety is not on. In FIG. 3, this plate is in a position awaiting firing while in FIG. 4, the plate is withdrawn to effect a firing but only if the safety is also withdrawn.

A second plate 66 is next provided. The second plate is positionable between the striker element and the bullet to constitute a safety. The safety is on in both FIGS. 3 and 4 but could be withdrawn to allow for firing of the bullet.

In FIG. 5, both the plates are withdrawn. The safety plate 66 is withdrawn so as not to preclude firing while the first plate 64 is also withdrawn to allow firing or discharge of the bullet.

Both the first plate and the second plate are formed with forks 68 from their free or far end to allow the point of the striker element to essentially extend through the plates. This arrangement also allows the free or far ends to be supported by aligned recesses 70 in the housing.

The last major component of the system is secondary electronic components. The secondary electronic components are located within the housing including electronic elements 74 coupled between the keypad and the second plate to effect plate withdrawal so as to allow the bullet to be discharged upon the holding of one key, preferably the star key and upon the depression of another key, preferably the three (3) key. The selection of keys physically distant from each other abates the possibility of accidental discharge.

The secondary electronic components also include secondary electronic elements 76 coupled between the key pad and the safety plate to effect its advance and withdrawal so as to be adapted to (A) retain the safety in a first safety orientation between the striker element and bullet upon the punching in of a preselected multi-digit number and (B) retain the safety in a second release orientation not between the striker element and bullet upon punching in a separate pre-selected number, preferably a multi-digit number with one of the numbers being the pound key.

A preferred combination of numbers for actuating the safety might well be 562-587#, LOCKUP#, while a combination for de-activating the safety might well be 865-625#, UNLOCK#. These would be easily remember codes. Other numbers could, however, be readily be modified to suit a user as could the firing sequence.

Described above is the primary embodiment of the invention wherein the firearm is concealed within an electronic device, preferably a cellular telephone. It should be understood, however, that the electronic device could take the form of any of a wide variety of electronic devices, as for example, pagers, remote door openers, remote TV/appliance controls, hand held computers, calculators, portable electronic learning devices/games or the like.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electronic device with a concealed firearm comprising:

a housing having an interior face and an exterior face and a peripheral side wall there between and with a cavity therein, the housing having a plurality of buttons including a keypad and digital electronics;

a tubular wall with a rigid central bore adapted to function as the barrel of a firearm, the tubular wall having an interior end communicating with the cavity and an exterior end communicating with exterior of the housing;

a chamber for receiving a bullet formed of a shell and a slug adjacent to the interior end of the bore;

a striker element positioned on the side of the bullet with a point adapted to strike the shell at the rear face of the bullet to discharge the bullet and propel the slug thereof outwardly therefrom through the bore;

an actuator on the side of the striker remote from the bullet to initiate movement of the striker element into contact with the shell;

a mechanism when activated adapted to release the actuator to move the striker element and discharge the bullet;

a second mechanism positionable in association with the striker element and the bullet to constitute a safety; and primary electronic components within the housing including electronic elements coupled between at least one of the buttons and the first plate to allow the bullet to be discharged upon a first instruction from at least one of the buttons.

2. A device as set forth in claim 1 and further including:

secondary electronic elements coupled between at least one of the buttons and the safety adapted to (A) retain the safety in a first safety orientation between the striker element and bullet upon a second instruction from at least one of the buttons and to (B) allow the safety to be retained in a second operational orientation upon a third instruction from at least one of the buttons.

3. The device as set forth in claim 1 wherein the device has the appearance of a telephone.

4. The device as set forth in claim 1 wherein the device is a cellular telephone.

* * * * *